United States Patent [19]

Masaki

[11] Patent Number: 4,461,223

[45] Date of Patent: Jul. 24, 1984

[54] METHOD AND AN APPARATUS FOR PRODUCING MOISTURIZED HOT AIR

[75] Inventor: Saburou Masaki, Misaki, Japan

[73] Assignee: Hiroyashi Iizuka, Chiba, Japan

[21] Appl. No.: 533,724

[22] Filed: Sep. 19, 1983

Related U.S. Application Data

[63] Continuation of Ser. No. 309,544, Oct. 7, 1981, abandoned.

[30] Foreign Application Priority Data

Oct. 27, 1980 [JP] Japan ..... 55-150563

[51] Int. Cl.[3] ..... F23J 15/00

[52] U.S. Cl. ..... 110/215; 110/234; 110/345; 122/31 R

[58] Field of Search ..... 110/150, 215, 234, 345; 122/31 R, 31 A; 126/360 A; 431/4, 190

[56] References Cited

U.S. PATENT DOCUMENTS

| | | | |
|---|---|---|---|
| 42,904 | 5/1864 | True | 122/31 R |
| 452,831 | 5/1891 | Brown | 110/234 |
| 4,245,569 | 1/1981 | Fallon | 110/345 |

*Primary Examiner*—Edward G. Favors
*Assistant Examiner*—Steven E. Warner
*Attorney, Agent, or Firm*—James Creighton Wray

[57] ABSTRACT

Moisturized hot air having a high temperature and a high humidity is produced by mixing high-temperature combustion gas with low-temperature steam.

A low-temperature steam chamber generates low-temperature steam under low pressure and low temperature. A combustion chamber furnishes heat for steam generation to the low-temperature steam chamber. A flue connects the combustion chamber to the low-temperature steam chamber.

1 Claim, 2 Drawing Figures

METHOD AND AN APPARATUS FOR PRODUCING MOISTURIZED HOT AIR

This application is a continuation of application Ser. No. 309,544, filed Oct. 7, 1981, now abandoned.

The present invention relates to a method and an apparatus for producing moisturized hot air, which has a high temperature and a high humidity.

In the prior art, there are two methods for obtaining the moisturized hot air. One is to reheat high-pressure steam generated in a high-pressure steam boiler. The other is to use jointly hot air produced with a seperate hot air generator and steam produced by a boiler.

However, the former method must consume a large quantity of heat energy for producing the moisturized hot air of a final object, because it needs a heat source for reheating the high-pressure steam in addition to a heat source for running the high-pressure steam boiler. Also, the latter method must consume a large quantity of heat energy, because it needs a heat source for steam generation in addition to a heat source for hot air generation. Furthermore, as combustion gas is exhausted directly into the atmosphere, these methods have a great heat loss, which may reach 30% to 40% of used fuel in accordance with a trial calculation.

An object of the present invention is to increase heat efficiency by utilizing combustion gas of the steam generation heat source for reheating steam, and to save energy consumption thereby. A feature of the present invention is to produce moisturized hot air by mixing high-temperature combustion gas with low-temperature steam.

Figure 1:
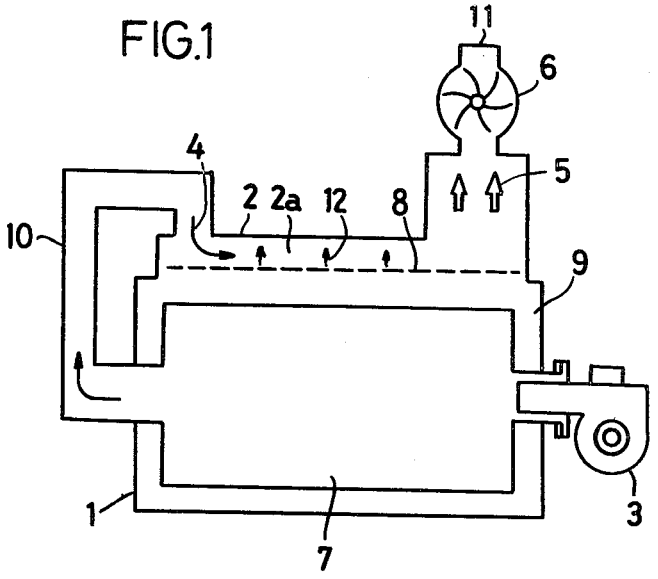
Figure 2:
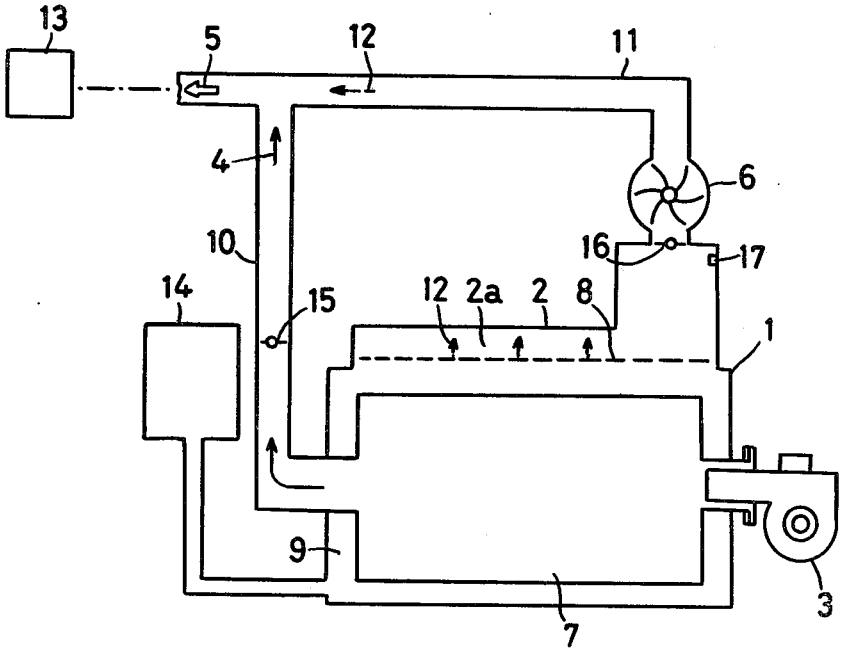

One way of carrying out the invention is described in detail below with reference to drawings which illustrate two specific embodiments, in which:

FIG. 1 is an elevation view of an apparatus for producing moisturized hot air of an embodiment of the invention, and FIG. 2 is an elevation view of an apparatus for producing moisturized hot air of another embodiment of the invention. FIG. 1 and FIG. 2 are drawn schematically.

Referring to FIG. 1, the apparatus 1 for producing moisturized hot air comprises a low-temperature steam chamber 2 which steams or evaporates chamber water 9 under low pressure and low temperature, a combustion chamber 7 which furnishes heat for steam generation to the low-temperature steam chamber 2, and a flue 10 which connects the combustion chamber 7 to the low-temperature steam chamber 2.

In the embodiment shown in FIG. 1, a burner 3 mounted on the combustion chamber 7 is a burner having a turbo-fan of high static pressure. Kerosene is used as a fuel for the burner 3, and is burnt with a reverse combustion mode. However, a structure and combustion mode of the burner are never limited to the above-mentioned, and all kinds of burner structure and combustion mode can be used through a suitable selection. Also, as a fuel for the burner, heavy oil, coal gas, natural gas, liquid propane gas and the like can be used optionally. Chamber water 9 is replenished consecutively from a water tank (not shown) so as to keep an evaporating surface of the water 9 at a given level within the low-temperature steam chamber 2. The combustion chamber 7 is disposed within the low-temperature steam chamber 2, and the chamber water 9 contacts with outer walls of the combustion chamber 7 and the flue 10. Therefore, the chamber water 9 is heated by heat-exchange through the outer walls. The chamber water 9 is also heated by the combustion gas 4 which is blown in an upper space 2*a* of the steam chamber 2 from the flue 10.

A steam supply duct 11 connects the upper space 2*a* of the low-temperature steam chamber 2 to a place or plant (not shown) which uses moisturized hot air. A suction fan 6 is mounted within the steam supply duct 11 close to the upper space 2*a*. The upper space 2*a* of the low-temperature chamber is maintained at a lower pressure than the atmospheric pressure, for example, by 50 to 60 mmAg lower, owing to a suction action of the fan 6. And owing to such a pressure decreasing effect, the chamber water 9 can steam or evaporate at a low temperature, for example at 60° C. to 80° C., and become low temperature steam 12. The low-temperature steam 12 is mixed with the combustion gas 4 from the flue 10 so as to produce moisturized hot air 5 having a high temperature and a high humidity.

The moisturized hot air 5 is sucked from the upper space 2*a* of the low-temperature steam chamber by suction fan 6, and is supplied through the duct 11 to the using place or plant, such as a steam-curing plant for cement concrete products. The flue 10 can be equipped with a flow adjustable means such as a damper, which adjusts the supply amount of combustion gas to the low-temperature steam chamber 2. The temperature of moisturized hot air can be adjusted by the adjustment of the supply amount of combustion gas. Also, the steam supply duct 11 can be equipped with a flow adjustable means such as a damper between the suction fan 6 and the low-temperature steam chamber 2, which adjusts the suction amount of moisturized hot air 5. The pressure decrease amount of the upper space 2*a* of the low-temperature steam chamber 2 can be adjusted by the adjustment of the suction amount of moisturized hot air. The steam supply duct 11 may be equipped with a temperature sensor, for example, between the suction fan 6 and the low-temperature steam chamber 2. The flow adjustable means such as a damper can be controlled by a detection signal of the said sensor.

In the above-mentioned embodiment, as the combustion gas is blown in the low-temperature steam chamber 2 which maintains low pressure below the atomospheric pressure, sulphurous acid gas contained in the combustion gas is easily condensed so as to contribute to desulphurization. Namely, the chamber water 9 containing sulphuric acid is drawn out of the low-temperature steam chamber 2, and then the drawn water 9 is counteracted by a suitable disposal. Sulphurous acid gas mixed in the moisturized hot air can be removed completely or decreased sharply thereby. Thus, the apparatus 1 and the method of the embodiment is superior as a countermeasure to public poisoning problems.

Mixing of the low-temperature steam and the combustion gas can be performed not only in the low-temperature steam chamber but also in the steam supply duct. Furthermore, the mixing process can be performed in a terminal of the steam supply duct, namely, just before using the moisturized hot air.

In the embodiment shown in FIG. 2, the apparatus 1 also comprises the low-temperature steam chamber 2, the combustion chamber 7, and the steam supply duct 11 connecting the chamber 2 to a place or plant 13 which uses moisturized hot air. Although the flue 10 connects with the combustion chamber 7 at one end, the other end of the flue 10 is not connected to the low-temperature steam chamber 2 but to the steam supply duct 11 at halfway of the duct 11. Chamber water is replenished consecutively from a water tank 14 so as to keep an evaporating surface of the water 9 at a given level within the low-temperature steam chamber 2.

The flue 10 is equipped with a flow adjustable means 15 such as a damper, which adjusts the supply amount of the combustion gas to the steam supply duct 11. The temperature of moisturized hot air 5 can be adjusted by the said means 15. Also, the steam supply duct 11 is equipped with a flow adjusting means 16 such as a damper between the suction fan 6 and the low-temperature steam chamber 2, which adjusts the suction amount of the low-temperature steam 12. And, the pressure decrease amount of the upper space 2*a* of the low-temperature steam chamber 2 is adjusted thereby. The steam supply duct 11 may be equipped with a temperature sensor 17 between the suction fan 6 and the steam chamber 2. The flow adjusting means is controlled by detection signals of the senser 17.

The place and mode for mixing the low-temperature steam 12 and the combustion gas 4 are never limited to the above-mentioned. For example, they can be mixed with a mixing chamber or a mixing tube inserted into the steam supply duct 11. Also, they can be mixed by sucking the combustion gas 4 with the current speed of the low-temperature steam 12 through the flue 10, which connects with the steam supply duct 11 at the side wall of the duct 11.

In accordance with the present invention, the moisturized hot air is produced by mixing the high-temperature combustion gas 4 to the low-temperature steam 12, and the heat source for generating the low-temperature steam 12 is the identical source for reheating the steam 12. Therefore, the consumption amount of fuel is decreased, and the heat efficiency is highly increased with the effective utilization of the heat source. Thus, the present invention is superior as a measure for saving energy. Also, the humidity of the moisturized hot air 5 can be increased more highly, because the moisture in the combustion gas 4 is added to the moisture of the low-temperature steam 12.

I claim:

1. Apparatus for producing moisturized hot air comprising a low-temperature steam chamber generating low-temperature steam at sub-atmospheric pressure and low temperature, a combustion chamber furnishing heat for steam generation to the low-temperature steam chamber, said low-temperature steam chamber surrounding the combustion chamber to receive heat for steam generation from the combustion chamber, chamber water surrounding the low-temperature steam chamber, a flue connecting the combustion chamber to the low-temperature steam chamber so as to mix high-temperature combustion gas in the combustion chamber with low-temperature steam in the low-temperature steam chamber, a supply duct connecting an upper space of the low-temperature steam chamber to means for using moisturized hot air, and suction means connected to the supply duct adjacent the upper space of the low-temperature steam chamber at sub-atmospheric pressure, the suction means comprising a suction fan mounted within the supply duct, the upper space of the low-temperature steam chamber being defined by a space between the chamber water level and an uppermost wall of the low-temperature steam chamber thereby providing a horizontal passageway which connects the flue to the supply duct and in which low-temperature steam rises from the chamber water and is mixed with high-temperature combustion gas, the mixture producing moisturized hot air and condensation of sulfurous acid gas which becomes trapped in the chamber water, eventually being drawn off, thereby providing desulfurization of the moisturized hot air.

* * * * *